US005566886A

United States Patent [19]

Wang

[11] Patent Number: 5,566,886

[45] Date of Patent: Oct. 22, 1996

[54] GARDENING-USED VARIATIONAL SPRINKLING HEAD WITH FULLY DISCHARGING OPENINGS

[75] Inventor: King-Yuan Wang, Changhua Hsien, Taiwan

[73] Assignee: Yuan Mei Corp., Changhua Hsien, Taiwan

[21] Appl. No.: 379,933

[22] Filed: Jan. 27, 1995

[51] Int. Cl.[6] ..... A62C 31/02

[52] U.S. Cl. ..... 239/394; 239/447; 239/522; 239/526

[58] Field of Search ..... 239/525, 526, 239/522, 548, 561, 562, 553.3, 553.5, 394, 447

[56] References Cited

U.S. PATENT DOCUMENTS

| | | | |
|---|---|---|---|
| 4,187,986 | 2/1980 | Petrovic | 239/561 |
| 4,666,085 | 5/1987 | Liaw | 239/526 |
| 4,903,897 | 2/1990 | Hayes | 239/525 |
| 4,909,443 | 3/1990 | Takagi | 239/538 |
| 5,232,162 | 8/1993 | Chin | 239/394 |
| 5,323,968 | 6/1994 | Kingston et al. | 239/526 |
| 5,348,228 | 9/1994 | Wang | 239/526 |
| 5,501,400 | 3/1996 | Kuo | 239/525 |

*Primary Examiner*—Andres Kashnikow

*Assistant Examiner*—Lisa Douglas

[57] ABSTRACT

A gardening-used variational sprinkling head with fully discharging openings, composed of a variational water-discharging cover and a base member associated therewith. The sprinkling head is associated with a sprinkling gun. The sprinkling gun has an inner water outlet. The water-discharging cover is formed with radial ribs inward projecting from inner periphery thereof to define several fully discharging openings. A circular mesh plate is placed within the radial ribs. Six different variational sprinkling holes and two close holes are integrally annularly arranged on a central portion of the mesh plate. The six variational sprinkling holes respectively have six rearward extending hollow posts which respectively abut against six water inlets annularly arranged on the base member. The base member is connected with the mesh plate by ultrasonic fusion and spaced from the radial ribs by a space so that water can pass through the fully discharging openings. The base member further has a fine mesh water inlet and a key-shaped depression formed on a back face thereof. The sprinkling head can be rotated to align one of the water inlets with the water outlet, permitting the water to flow through the water outlet and the aligned water inlet and discharge from the sprinkling head. When the key-shaped depression of the base member is aligned with the water outlet, the water flow through the interior of the sprinkling gun and out of the fully discharging openings and all the sprinkling holes.

1 Claim, 6 Drawing Sheets

GARDENING-USED VARIATIONAL SPRINKLING HEAD WITH FULLY DISCHARGING OPENINGS

BACKGROUND OF THE INVENTION

The present invention relates to a gardening-used variational sprinkling head with fully discharging openings. The sprinkling head is composed of a variational water-discharging cover and a base member associated therewith. The water-discharging cover is formed with radial ribs inward projecting from inner periphery thereof to define several fully discharging openings. A circular mesh plate is placed within the radial ribs. Six different variational sprinkling holes and two close holes are integrally annularly arranged on a central portion of the mesh plate. The base member has a fine mesh water inlet and a key-shaped depression formed on a back face thereof. When the sprinkling head is rotated to make the key-shaped depression of the base member aligned with a water outlet of a sprinkling gun connected with the sprinkling head, the water flow through the interior of the sprinkling gun and out of the fully discharging openings and all the sprinkling holes. A user can directly use a reverse water flow to inward flush the dirts on the sprinkling head into the sprinkling gun discharge the dirty water from the fully discharging openings without loosening the screw and removing the sprinkling head.

FIG. 1 shows a conventional gardening-used variational sprinkling gun, wherein several radial ribs 12 are disposed along inner periphery of the sprinkling head 10 and a mesh body 11 is disposed in a front central portion thereof and connected with the radial ribs 12. Each two adjacent ribs 12 define a fully discharging opening 13. According to the above arrangements, the water is discharged from the mesh body 11 and the peripheral fully discharging openings in one single pattern.

FIG. 2 shows another conventional gardening-used sprinkling gun, wherein the sprinkling head 10 is disposed with peripheral mesh body 11. Six variational sprinkling holes 14 are formed on a central portion 15 of the sprinkling head 10. According to such arrangements, the water can be discharged from the peripheral mesh body 11 or the central variational sprinkling holes 14 in two patterns.

Moreover, in the above two conventional sprinkling guns, when washing the sprinkling head from the dirts attaching to inner face thereof, a screw must be loosened to take down the sprinkling head for cleaning the same with clean water. Such procedure is troublesome. Therefore, it is necessary to provide an improved gardening-used variational sprinkling head which is able to sprinkle water in a mesh pattern, variational pattern or a fully discharging pattern and which can be easily cleaned up by reversely flushing water into the sprinkling head without loosening the screw.

SUMMARY OF THE INVENTION

It is therefore a primary object of the present invention to provide an improved gardening-used variational sprinkling head which is able to versatilely sprinkle water in a mesh pattern, variational pattern or a fully discharging pattern.

It is a further object of the present invention to provide the above sprinkling head which permits a user to directly use a reverse water flow to inward flush the dirts on the sprinkling head into the sprinkling gun discharge the dirty water from the fully discharging openings without loosening the screw and removing the sprinkling head.

According to the above objects, the sprinkling head of the present invention includes a variational water-discharging cover and a base member sealedly connected therewith by ultrasonic wave. The sprinkling head is associated with a head portion of a sprinkling gun. A central stepped post of the sprinkling gun is passed through a central through hole of the sprinkling head to engage with a screw. The sprinkling gun has an inner water outlet and a locating hole. A pin member sleeved by a spring is inserted in the locating hole. Several axial ribs are formed on inner wall of the water outlet and spaced from an open end of the water outlet by a space. A watertight O-ring is disposed in the space. The water-discharging cover is formed with radial ribs inward projecting from inner periphery of the cover. A circular mesh plate is placed within and connected with the radial ribs. Each two adjacent ribs define a fully discharging opening. Six different variational sprinkling holes and two close holes are integrally annularly arranged on a central portion of the mesh plate. The six variational sprinkling holes respectively have six rearward extending hollow posts which respectively abut against six water inlets annularly arranged on the base member. An outer periphery of the base member abuts against a peripheral portion of the mesh plate and is spaced from the radial ribs by a space so that water can pass through the fully discharging openings. The base member is connected with the mesh plate by ultrasonic fusion to form the variational sprinkling head. The base member has a fine mesh water inlet and a key-shaped depression formed on a back face of the base member. A locating recess is formed on an outer side of each water inlet, whereby the sprinkling head can be rotarily adjusted to make the pin member extend into one of the locating recesses and align one of the water inlets with the water outlet of the sprinkling gun, so that the water is guided to flow through the water outlet and the aligned water inlet to be discharged from the sprinkling head. When the sprinkling head is rotated to make the key-shaped depression of the base member aligned with the water outlet, a rectangular portion of the depression is located outside the water outlet so that the water is guided into the sprinkling gun to flow out from the fully discharging openings defined by the ribs and all the sprinkling holes.

The present invention can be best understood through the following description and accompanying drawings, wherein:

DETAILED DESCRIPTION OF THE PREFERRED EMBODIMENT

Figure 1:
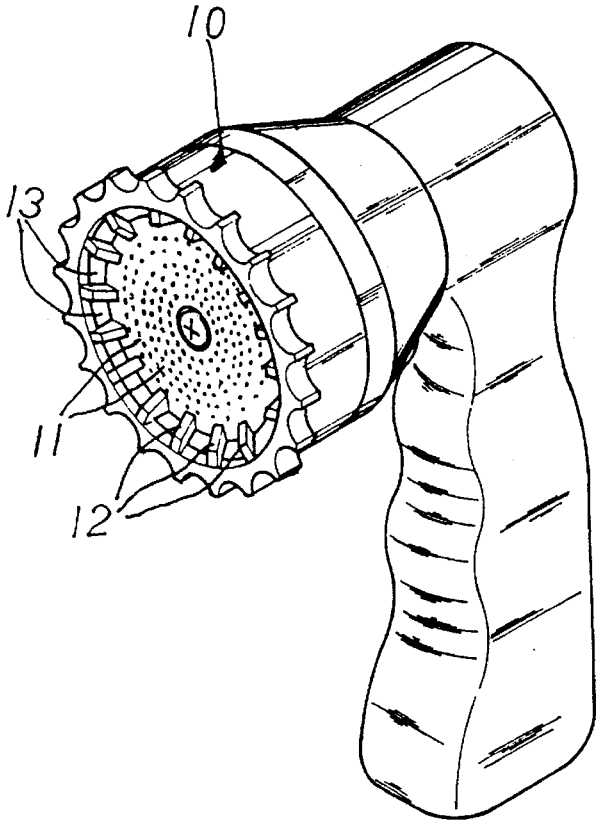
FIG. 1 PRIOR ART
FIG. 1 is a perspective view of a conventional gardening-used sprinkling head.
Figure 2:
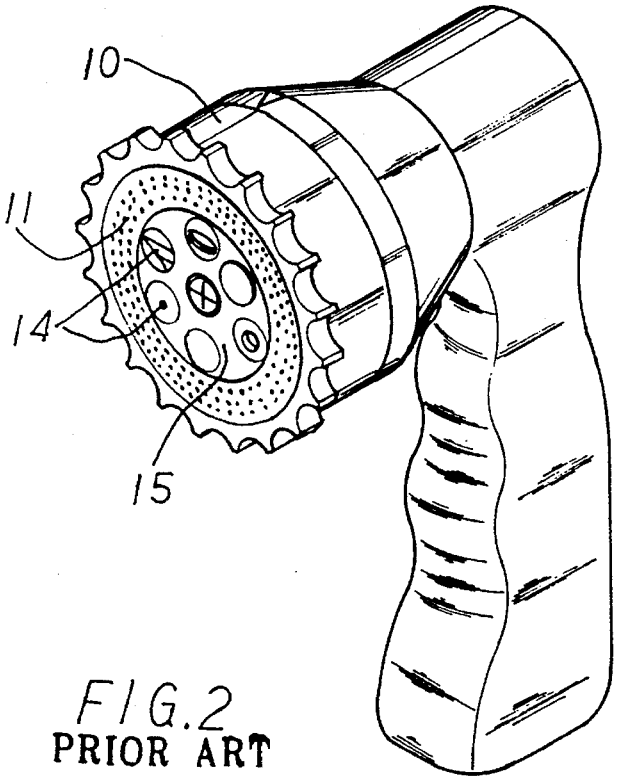
FIG. 2 PRIOR ART
FIG. 2 is a perspective view of another type of conventional gardening-used sprinkling head.
Figure 3:
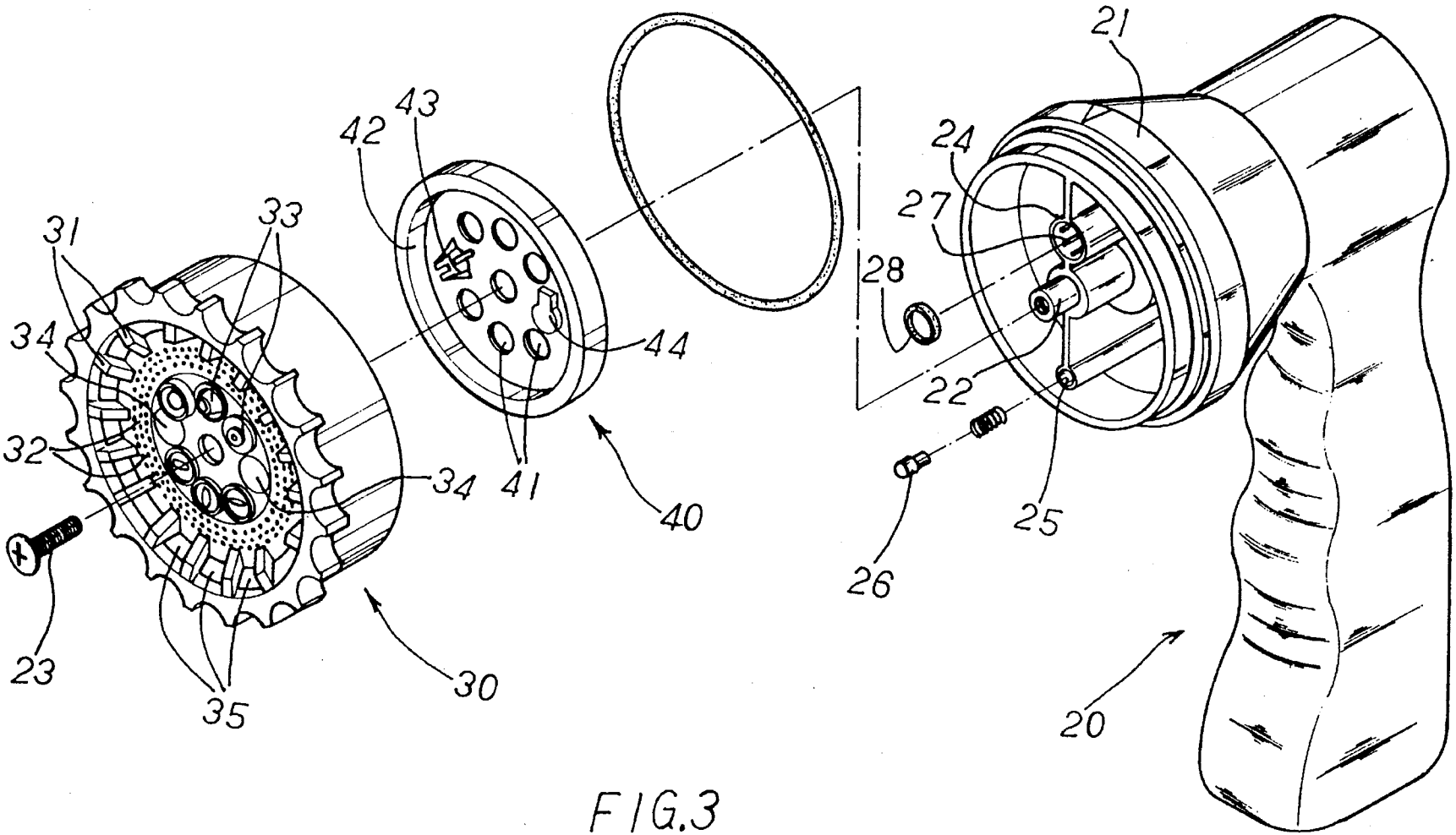
FIG. 3 is a perspective exploded view of the sprinkling head of the present invention.

Please refer to FIG. 3. The sprinkling head structure of the present invention includes a variational water-discharging cover 30 and a base member 40 sealedly connected therewith by ultrasonic wave. The sprinkling head is associated with a head portion 21 of a sprinkling gun 20. A central stepped post 22 of the sprinkling gun 20 is passed through a central through hole of the sprinkling head to engage with a screw 23. The sprinkling gun 20 has an inner water outlet 24 and a locating hole 25. A pin member 26 sleeved by a spring is inserted in the locating hole 25. Several axial ribs 27 are formed on inner wall of the water outlet 24 and spaced from the open end of the water outlet 24 by a space. A watertight O-ring 28 is disposed in the space. The water-discharging cover 30 is formed with radial ribs 31 inward projecting from inner periphery of the cover 30. A circular mesh plate 32 is placed within and connected with the radial ribs 31. Each two adjacent ribs 31 define a fully discharging opening 35. Six different variational sprinkling holes 33 and two close holes 34 are integrally annularly arranged on a central portion of the mesh plate 32.

Figure 4:
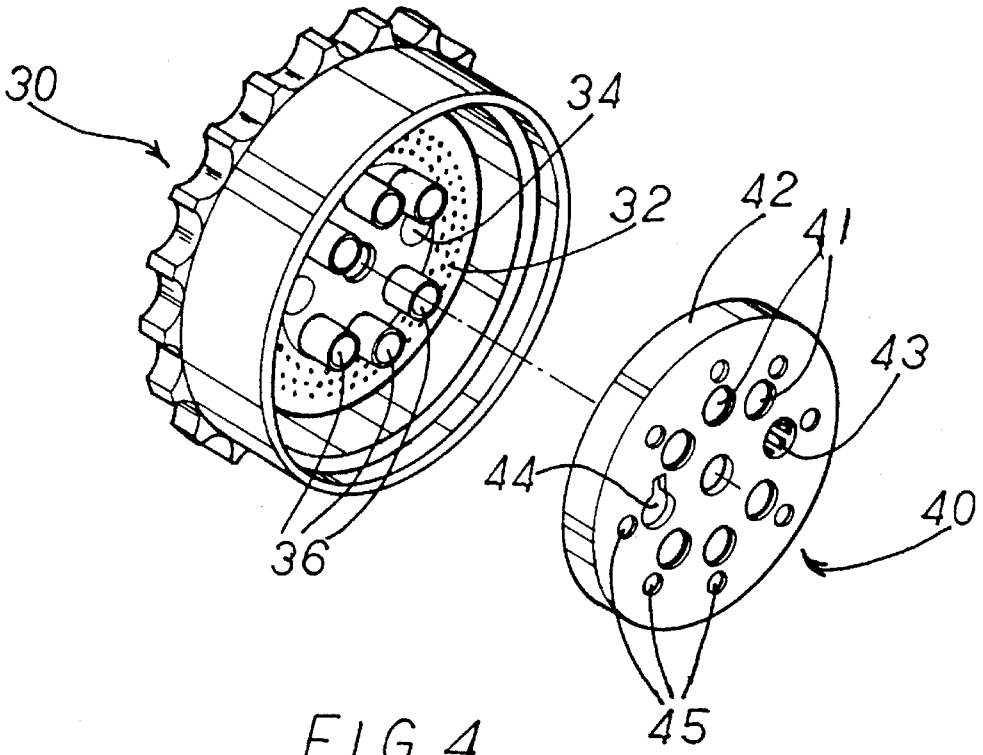
FIG. 4 is a perspective back view according to FIG. 3.
Figure 5:
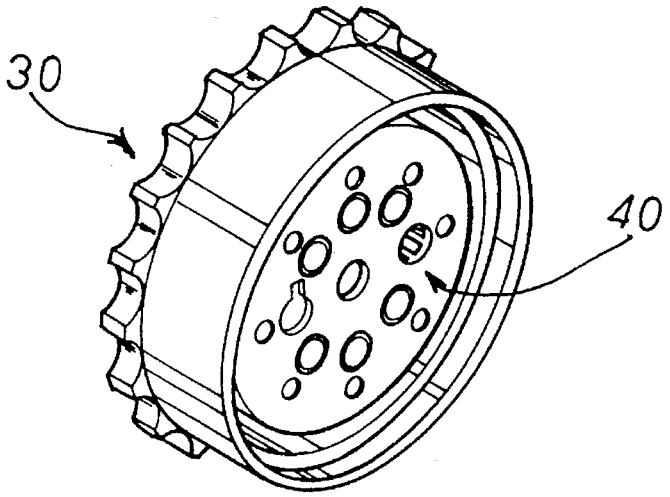
FIG. 5 is a perspective assembled view of the sprinkling head of the present invention.
Figure 6:
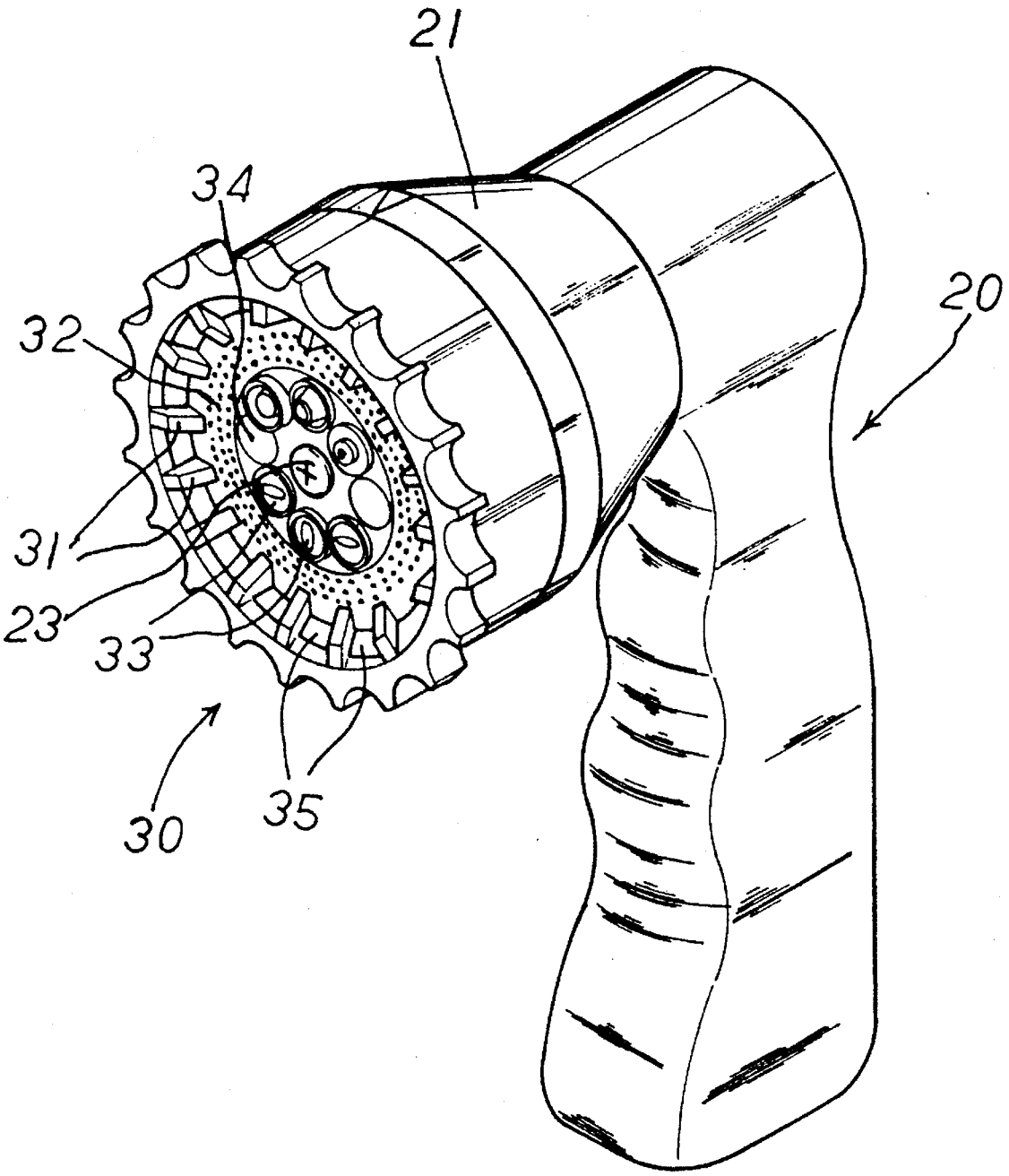
FIG. 6 is a perspective view showing that the sprinkling head is associated with the sprinkling gun.

Please refer to FIG. 4. The six variational sprinkling holes 33 respectively have six rearward extending hollow posts 36 which respectively abut against six water inlets 41 annularly arranged on the base member 40. An outer periphery 42 of the base member 40 abuts against a peripheral portion of the mesh plate 32 and is spaced from the ribs 31 by a space so that the water can pass through the fully discharging openings 35. The base member 40 is connected with the mesh plate 32 by ultrasonic fusion to form the variational sprinkling head as shown in FIG. 5. The base member 40 further has a fine mesh water inlet 43 and a key-shaped depression 44 formed on a back face of the base member 40. A locating recess 45 is formed on an outer side of each water inlet 41, whereby when the sprinkling head is assembled with the sprinkling gun 20 as shown in FIG. 6, the pin member 26 extends into one of the locating recesses 45, permitting the sprinkling head to be rotarily adjusted so as to align one of the water inlets 41 with the water outlet 24 of the sprinkling gun 20. Accordingly, the water is guided to flow through the water outlet 24 and the aligned water inlet 41 to be discharged from the sprinkling head.

Figure 7:
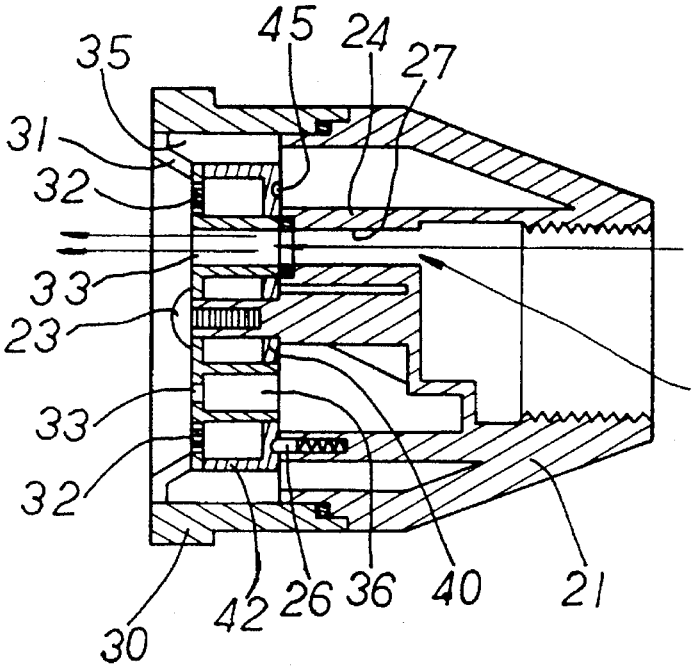
FIG. 7 is a sectional view showing that the sprinkling head is in a state for sprinkling the water in a variational pattern.

Please refer to FIG. 7. When rotating the sprinkling head to align one of the water inlets 41 of the base member 40 with the water outlet 24 of the sprinkling gun 20, the water is guided to directly flow out of one of the six variational sprinkling holes 33 of the sprinkling head.

Figure 8:
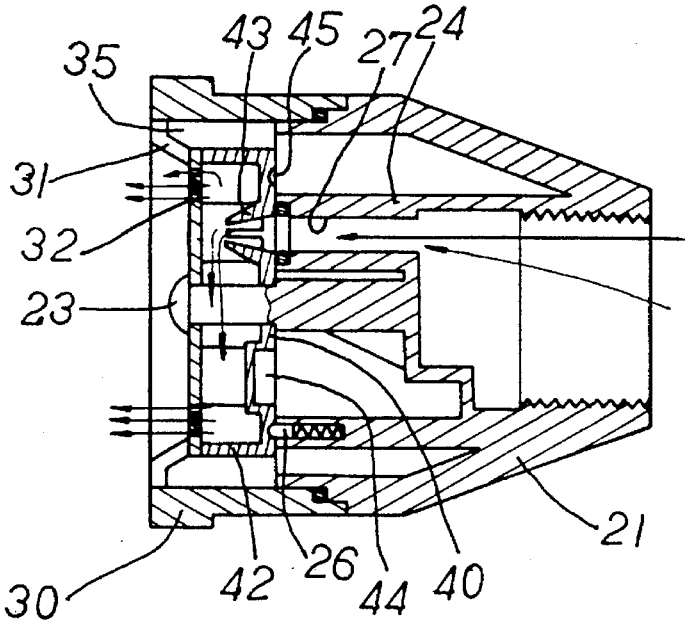
FIG. 8 is a sectional view showing that the sprinkling head is in a state for sprinkling the water in a mesh pattern.

Please refer to FIG. 8. When rotating the sprinkling head to make the fine mesh water inlet 43 aligned with the water outlet 24, the water is guided to flow into the interior of the sprinkling head and then be injected out from the meshes of the mesh plate 32 to form a network-like water flow.

Figure 9:
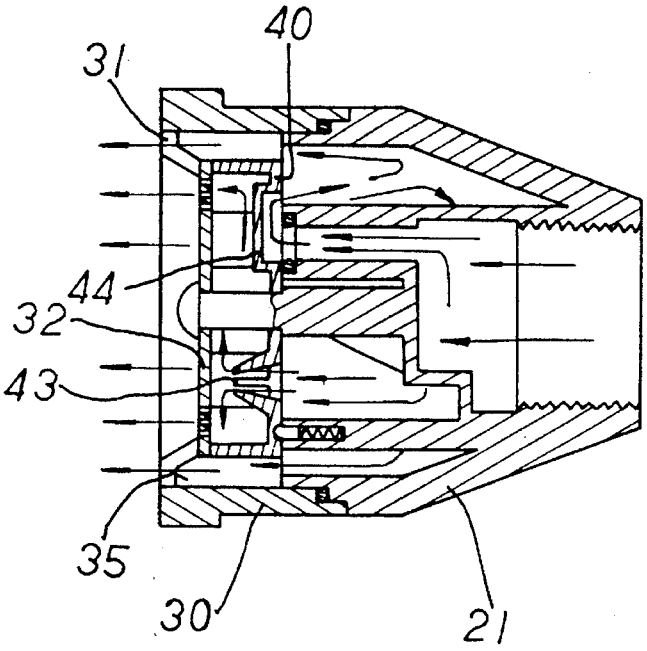
FIG. 9 is a sectional view showing that the sprinkling head is in a state for sprinkling the water in a fully discharging pattern.

As shown in FIG. 9, when the sprinkling head is rotated to make the key-shaped depression 44 of the base member 40 aligned with the water outlet 24, a rectangular portion of the depression 44 is located outside the water outlet 24 so that the water is guided into the sprinkling gun 20 to flow out from the fully discharging openings 35 defined by the ribs 31 and all the sprinkling holes.

Figure 10:
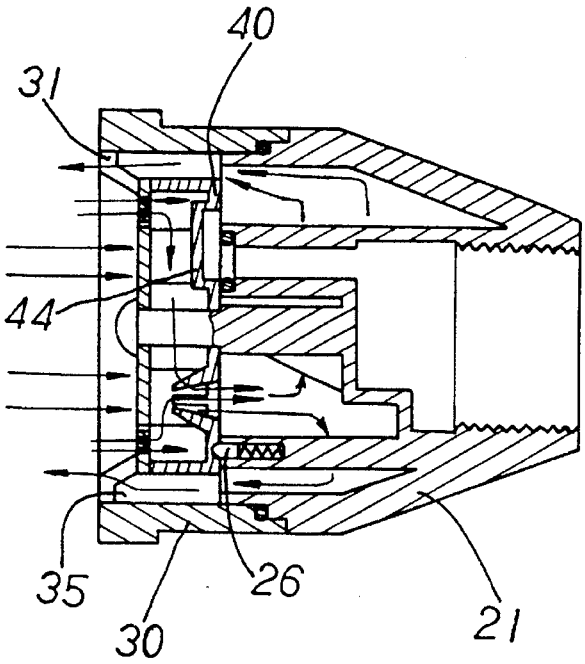
FIG. 10 is a sectional view showing that the sprinkling head is cleaned up from the dirts by reversely flushing water into the sprinkling head.

Please refer to FIG. 10. The fully discharging openings 35 permit a user to wash the sprinkling head in such a manner that the user can directly reversely flush clean water from outer side into the sprinkling head. The reverse water flow can easily flush the dirts on the sprinkling head into the sprinkling gun 20. The water carrying the dirts can then be discharged from the fully discharging openings 35 of the sprinkling gun 20. Therefore, the sprinkling gun and sprinkling head can be easily cleaned up without loosening the screw and removing the sprinkling head.

The above embodiment is only an example of the present invention and the scope of the present invention should not be limited to the example. Any modification or variation derived from the example should fall within the scope of the present invention.

What is claimed is:

1. A gardening-used variational sprinkling head with fully discharging openings, comprising a variational water-discharging cover and a base member sealably connected therewith by ultrasonic wave, the sprinkling head being associated with a head portion of a sprinkling gun, a central stepped post of the sprinkling gun being passed through a central through hole of the sprinkling head to engage with a screw, the sprinkling gun having an inner water outlet and a locating hole, a pin member sleeved by a spring being inserted in the locating hole, several axial ribs being formed on inner wall of the water outlet and spaced from an open end of the water outlet by a space, a watertight O-ring being disposed in the space, the water-discharging cover being formed with radial ribs inward projecting from inner periphery of the cover, a circular mesh plate being placed within and connected with the radial ribs, each two adjacent ribs defining a fully discharging opening, six different variational sprinkling holes and two close holes being integrally annularly arranged on a central portion of the mesh plate, the six variational sprinkling holes respectively having six rearward extending hollow posts which respectively abut against six water inlets annularly arranged on the base member, an outer periphery of the base member abutting against a peripheral portion of the mesh plate and being spaced from the radial ribs by a space so that water can pass through the fully discharging openings, the base member being connected with the mesh plate by ultrasonic fusion to form the variational sprinkling head, the base member further having a fine mesh water inlet, a locating recess being formed on an outer side of each water inlet, whereby the sprinkling head can be rotatable adjusted to make the pin member extend into one of the locating recesses and align one of the water inlets with the water outlet of the sprinkling gun, so that the water is guided to flow through the water outlet and the aligned water inlet to be discharged from the sprinkling head, said sprinkling head being characterized in that a key-shaped depression being formed on a back face of the base member, whereby when the sprinkling head is rotated to make the key-shaped depression of the base member aligned with the water outlet, a rectangular portion of the depression is located outside the water outlet so that the water is guided into the sprinkling gun to flow out from the fully discharging openings defined by the ribs and all the sprinkling holes.

* * * * *